United States Patent [19]

Rioux, Sr.

[11] Patent Number: 4,750,793

[45] Date of Patent: Jun. 14, 1988

[54] DISPLAY CASE WITH ADJUSTABLE BOTTOM

[75] Inventor: Robert A. Rioux, Sr., North Syracuse, N.Y.

[73] Assignee: Rioux's Wildlife in Wood and Pewter, Syracuse, N.Y.

[21] Appl. No.: 920,453

[22] Filed: Oct. 20, 1986

[51] Int. Cl.[4] ..... A47F 3/06

[52] U.S. Cl. ..... 312/114; 312/205; 312/284; 312/351

[58] Field of Search ..... 312/284, 22, 102, 114, 312/257 A, 205, 243, 253, 278, 351, 312; 108/91.92; 248/558, 224.1, 224.2, DIG. 11, DIG. 12

[56] References Cited

U.S. PATENT DOCUMENTS

| | | | |
|---|---|---|---|
| 139,805 | 6/1873 | Morrison | 312/22 |
| 284,531 | 9/1883 | Berry | 312/284 X |
| 655,952 | 8/1900 | Beerling | 312/114 |
| 734,644 | 7/1903 | Wilton | 312/114 |
| 2,023,260 | 12/1935 | Beers et al. | 312/114 |
| 2,172,605 | 9/1939 | Bourn | 312/351 X |
| 2,326,507 | 8/1943 | Welch, Jr. | 312/351 X |
| 2,683,639 | 7/1954 | Brenny | 312/243 X |
| 3,259,082 | 7/1966 | Williams | 108/92 X |
| 3,932,113 | 1/1976 | Thrush | 248/DIG. 12 X |

FOREIGN PATENT DOCUMENTS

| | | | |
|---|---|---|---|
| 273422 | 7/1927 | United Kingdom | 312/284 |

*Primary Examiner*—Peter A. Aschenbrenner
*Assistant Examiner*—Thomas A. Rendos
*Attorney, Agent, or Firm*—Wall and Roehrig

[57] ABSTRACT

A display case having a base frame upon which is mounted a transparent enclosure and further including a floor panel for supporting an object to be displayed which interlocks with the base frame at different positions so that the supporting surface can be recessed at different levels within the base frame.

5 Claims, 3 Drawing Sheets

DISPLAY CASE WITH ADJUSTABLE BOTTOM

BACKGROUND OF THE INVENTION

This invention relates to a display case and, in particular, to a case suitable for displaying relatively small collectable items or stuffed animals.

Many collectors of stuffed anmimals, such as birds and the like, like to house the animals in enclosed display cases to protect the animal from dust and dirt. The base of the display case is usually dressed in various ways to show the animal in its natural habitat. Soil and sand may be used to produce a ground-like effect. Sometimes foliage is also added to further enhance the surrounding. Some collectors even use colored acrylic materials that can be applied to the base to simulate water and rock formations. It is therefore desirous to recess the base to various degrees in order to accomodate these materials and provide the scene with depth. Those collecting inanimate objects not requiring scenic enhancement usually want the base to be a smooth continuous surface of one color which will best present the item being displayed. As a consequence, the collector must either stock a wide variety of different display cases or spend a good deal of time shopping for the exact configurations that he needs to properly display a particular item.

SUMMARY OF THE INVENTION

It is therefore an object of this invention to improve cases for displaying various objects and in particular, for displaying small stuffed animals.

A further object of the present invention is to provide a display case having a support platform that can be selectively set at varying depths within the base of the case.

Another object of the present invention is to provide collectors with a single display case that allows for the creation of a wide number of different settings.

These and other objects of the present invention are attained by means of a case for displaying various objects in different settings that has a base frame upon which is seated a transparent enclosure. The base frame further includes a removable floor panel that interlocks with the base by means of a series of steps that enable the panel to be flush mounted with the top surface of the base or selectively recessed at various depths therebelow.

BRIEF DESCRIPTION OF THE DRAWINGS

For a better understanding of these and other objects of the invention, reference is had to the following detailed description of the invention which is to be read in conjunction with the included drawings, wherein.

DESCRIPTION OF THE INVENTION

Figure 1:
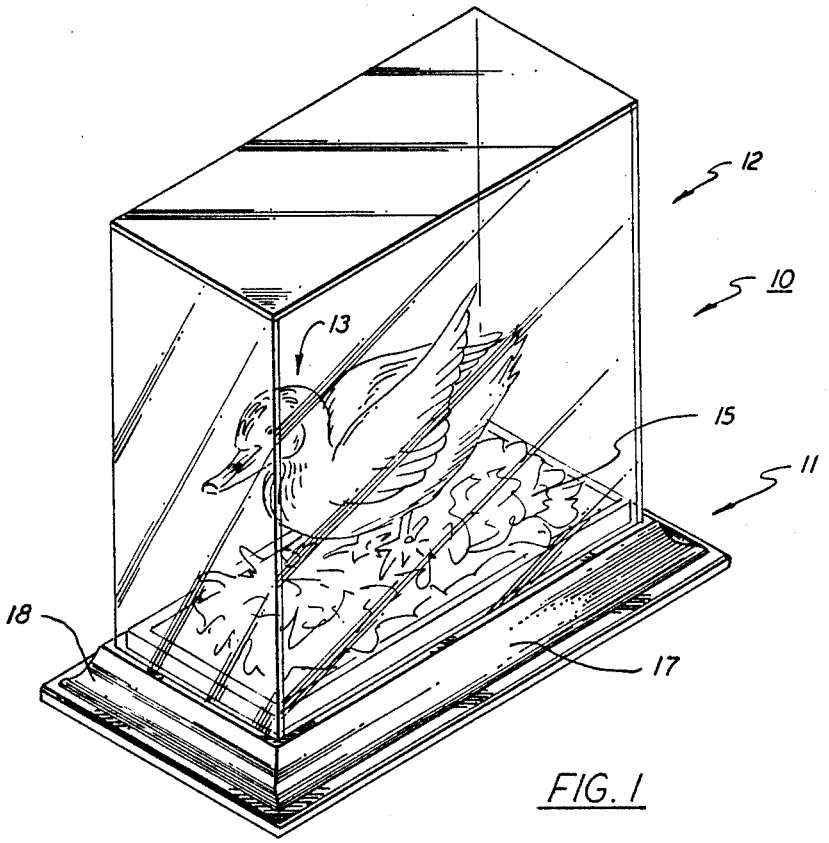
FIG. 1 is a perspective view of a display case embodying the teachings of the present invention showing a small bird contained therein.

Turning initially to FIG. 1 there is shown a rectangular shaped display case, generally referenced 10, that includes a wooden base frame 11 upon which is seated a raised transparent enclosure 12 housing a stuffed animal 13 upon the base. The animal depicted in the drawing is a small bird that is standing on a platform which is recessed within the base frame. The recess is filled with soil and foliage generally referenced 15 to provide a life-like setting for the animal. As previously noted, many collectors of animals and other objects of interest wish to create settings that are enhanced by recessing the object support platform to some degree. For example a small trophy may demand a flat support surface for the most effective display. An animal on the other hand might be most effectively displayed standing inside a deep recess that is filled with soil and foliage and perhaps accented with water simulating acrylic paint. As will be explained in greater detail below, the display case of the present invention enables the user to selectively adjust the vertical position of the support platform to best suit the object being displayed.

The construction of the base frame 11 will be described in greater detail in FIGS. 2–5. Preferably the base frame is rectangular in shape with the sides of the base being formed preferably from a hard-wood that can be worked on a cutting machine and which also can be finished to a deep luster. The outside side walls 17–18 of the frame are contoured to enhance aesthetic appearance of the base. A flat shoulder 19 is cut downwardly through the top surface 20 of the base frame about its entire outer periphery. The cutout formed by the shoulder provides a raised lip 21 (FIG. 2) about the frame. In assembly, the open bottomed enclosure is seated upon the shoulder 19 with the lip 21 passing upwardly along the inside edge of the opening. The lip helps to support and align the enclosure on the base and prevents it from becoming accidentally dislodged. The enclosure is formed of four side walls and a top wall that are all made of an optically clear, fracture resistant, acrylic material. The object being displayed can thus be viewed from any direction.

The inside of the base frame is provided with an opening 25 (FIG. 2) that passes vertically between the horizontal top surface 20 and the horizontal bottom surface 26 of the frame. The opening is rectangular shaped and is centered upon the vertical axis of the base frame. A restricted inner chamber 27 having vertical side walls is contained within the opening. The opening is stepped back or expanded horizontally an equal distance into the side walls of the frame both above and below the inner chamber to form an upper chamber 30 and lower chamber 31. An expanded access hole 32 is passed upwardly through the bottom surface of the base frame and communicates with the lower chamber 31. The purpose of the access hole shall be explained in greater detail below.

A removable floor panel, generally referenced 35, is used to close the opening in the base frame and thus furnish a support platform for an object being displayed. The floor panel contains two rectangular sections, a larger top section 37 and a smaller lower section 38 that are aligned about a common vertical axis. The top section compliments the peripheral form of the upper and lower chambers 30 and 31 while the bottom section compliments the peripheral shape of the inner chamber 27. The thickness of the top section is equal to the depth of the upper chamber 30 while the thickness of the bottom section is equal to the depth of the inner chamber. The two sections making up the floor panel can be formed from the same piece of material or each section formed separately and joined by any suitable means in assembly.

Figure 2:
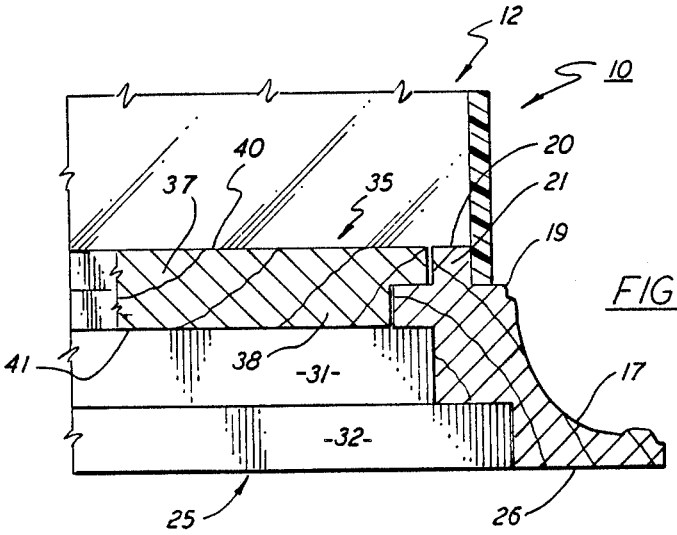
FIGS. 2–5 are partial side views in section of the base of the display case shown in FIG. 1 showing the floor panel set at various depths within the base.

As shown in FIG. 2, the floor panel can be inserted into the opening through the top surface of the base frame in position so that the top section 37 is seated within the upper stepped chamber 30 while the smaller bottom section 38 is seated within the inner chamber 27. In this configuration, the top wall 40 of the panel is flush mounted with the top surface 20 of base frame to provide the inside of the case with a smooth uninterrupted support surface upon which an object can be displayed.

Figure 3:
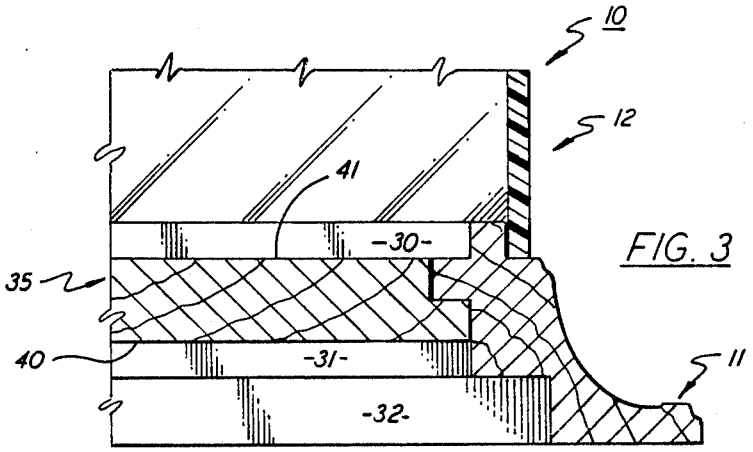

The floor panel can also be inverted and passed upwardly through the bottom of the base frame as shown in FIG. 3. Here again, the bottom section of the floor panel is received within the inner chamber 27 which the larger top section being received within the bottom lower chamber 31. The inverted bottom wall 41 of the panel is now recessed below the top surface 20 of the base frame an amount equal to the depth of the upper chamber 30. The floor panel may be held in the base by any suitable means such as by use of adhesive cement, tacks, staples or the like.

Figure 4:
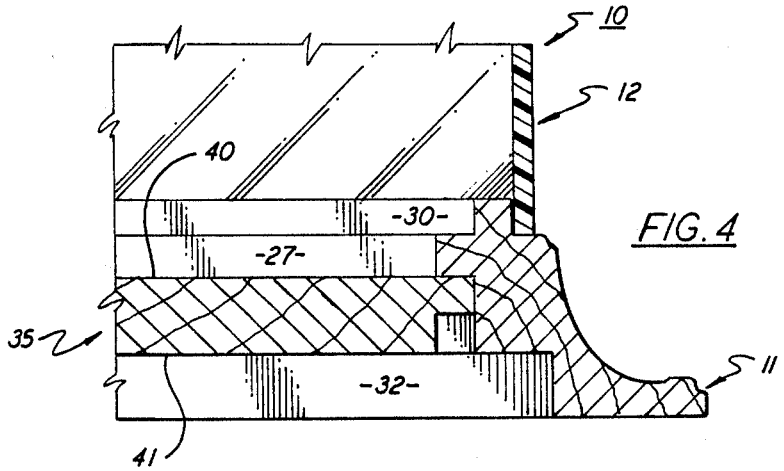

The floor panels can also be inserted into the frame opening through the bottom as shown in FIG. 4, in an upright or non-inverted position whereupon the larger top section of the panel is received in the lower chamber 31. The top wall 40 of the panel now forms the support surface for the displayed object and is recessed to a depth equal to the combined depth of the inner chamber 28 and the upper chamber 30.

Figure 5:
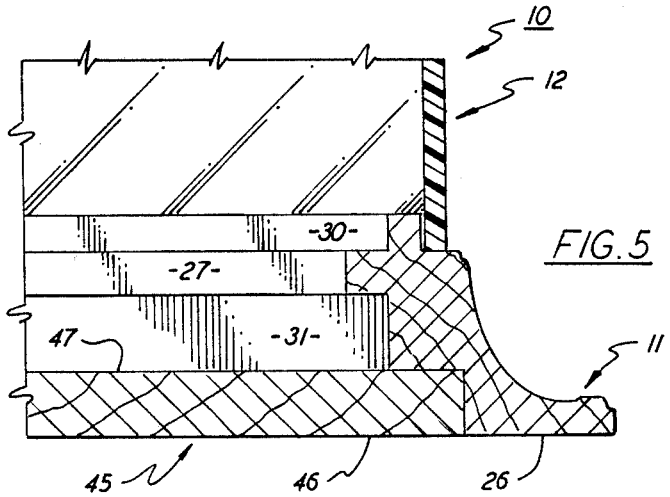

A second rectangular closure panel 45, used as illustrated, can be used in place of the stepped floor panel to close the base frame as illustrated in FIG. 5. The closure panel fits snugly into the expanded hole 32 formed in the bottom of the base frame to fully fill the hole. The panel again is secured to the base frame by any suitable means so that the bottom surface 46 of the panel is flush with the bottom surface 26 of the frame as shown. The top surface 47 of the panel is now deeply recessed within the base frame to a depth equal to the combined depth of chambers 27, 30 and 31, and provide the support surface for the object being displayed.

Figure 6:
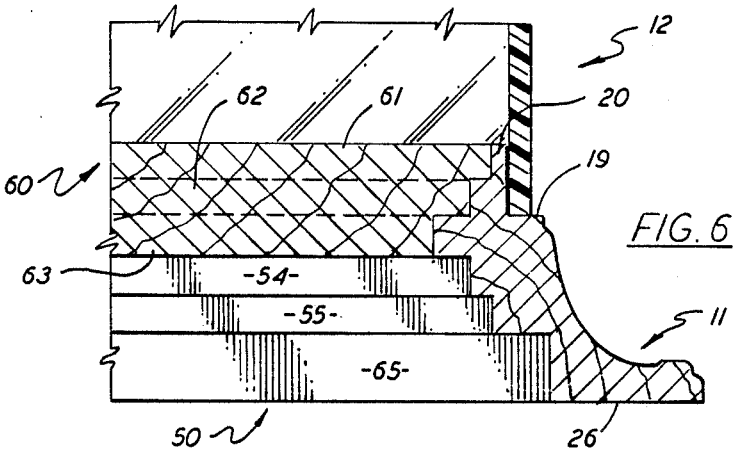
FIGS. 6–8 are also partial side views in section showing another form of the invention with the floor panel set at various depths within the base.
Figure 7:
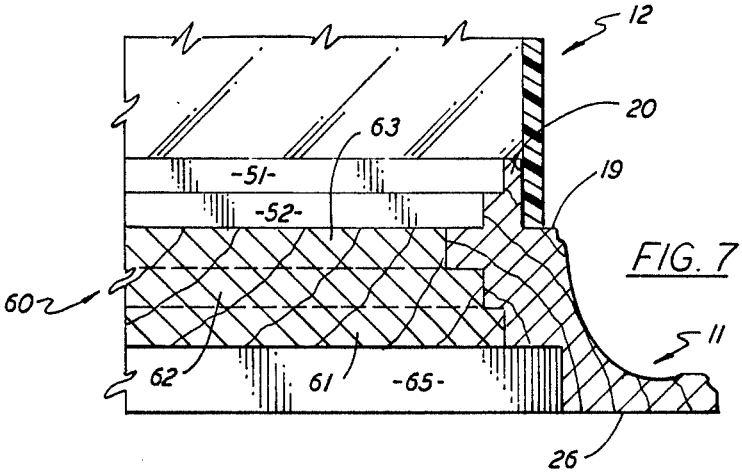
Figure 8:
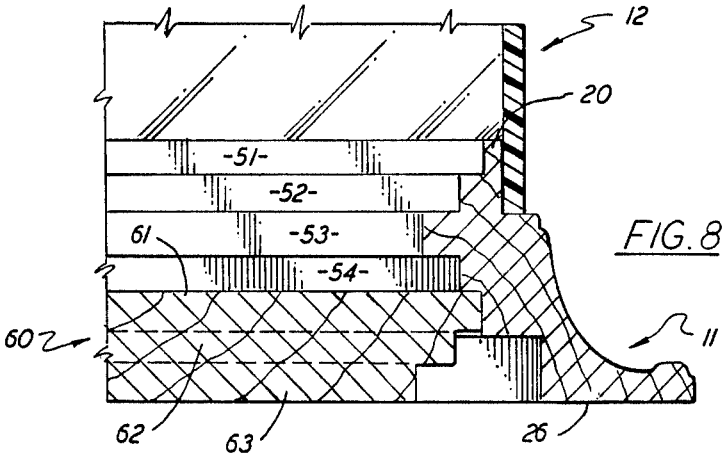

FIGS. 6–8 show a second embodiment of the invention wherein a vertically disposed opening 50, in the base frame 11 has two uniform stepped chambers 51 and 52 situated above an inner chamber 53 and two uniform stepped chambers 54 and 55 situated below the inner chamber. A stepped floor panel 60 is provided for closing the opening. The panel has three horizontally expanded sections that include an upper section 61, an intermediate section 62, and a lower section 63. The sections again are arranged so they interlock within the steps formed in the opening by the expanded chambers. An expanded hole 65 is provided in the bottom of the frame which communicates with the last lowermost chamber 55. The depth of hole 65 is equal to the combined thickness of the intermediate and top sections of the floor panel. As a result, the entire panel can be housed inside the base frame where the panel is inserted into the opening in an upright position as shown in FIG. 8.

As can be seen in this second embodiment, the panel can be arranged as shown in FIGS. 6–8 to provide for more pronounced changes in the depth of recess than found in the first embodiment of this invention without the need of changing the height of the base frame. Depending on the type of object to be displayed, this arrangement might be more suitable to the user than that of the first embodiment.

While this invention has been described with reference to the structure disclosed herein, it is not confined to the details set forth and this application is intended to cover any modifications or changes as may come within the scope of the following claims.

I claim:

1. A case for displaying objects that includes, a base having horizontally disposed top and bottom surfaces and a vertically disposed opening passing through the two surfaces, said opening having a midsection of a predetermined size and shape, a wider upper section stepped back above the midsection and a wider lower section stepped back below the midsection of the opening, said upper and lower sections being in vertical alignment and having the same cross sectional dimensions, a multi-tiered floor panel for closing the opening in the base that has a first tier that complements the shape of the midsection of said opening and a second wider tier that complements the shape of either the upper or the lower section of said opening whereby the floor panel can be selectively inserted into the opening whereby the floor panel can be selectively inserted into the opening through either the top or the bottom surface of the base in either an upright or an inverted position to provide a support platform for an object, an open bottomed enclosure seated upon the top surface of the base having a window for viewing an object housed therein.

2. The case of claim 1 wherein said base contains a recessed shoulder in the top surface thereof for slidably receiving the enclosure therein.

3. The case of claim 2 wherein the enclosure is formed of a transparent material.

4. The case of claim 1 wherein the vertically disposed opening in the base is rectangular in form and is centered about the vertical axis of the base.

5. The case of claim 1 that further includess means for securing the floor panel to the base in one of said selected positions.

* * * * *